US010589518B2

(12) United States Patent
Barbet

(10) Patent No.: US 10,589,518 B2
(45) Date of Patent: Mar. 17, 2020

(54) METHOD AND DEVICE FOR THE HYDRODYNAMIC DEFLECTION OF AN INK JET

(71) Applicant: Dover Europe Sàrl, Vernier (CH)

(72) Inventor: Bruno Barbet, Etoile-sur-Rhone (FR)

(73) Assignee: DOVER EUROPE SARL, Vernier (CH)

( * ) Notice: Subject to any disclaimer, the term of this patent is extended or adjusted under 35 U.S.C. 154(b) by 2 days.

(21) Appl. No.: 15/957,031

(22) Filed: Apr. 19, 2018

(65) Prior Publication Data

US 2018/0304619 A1 Oct. 25, 2018

(30) Foreign Application Priority Data

Apr. 21, 2017 (FR) ..... 17 53509

(51) Int. Cl.

| | |
|---|---|
| ***B41J 2/03*** | (2006.01) |
| ***B41J 2/09*** | (2006.01) |
| ***B41J 2/175*** | (2006.01) |
| ***B41J 2/02*** | (2006.01) |

(Continued)

(52) U.S. Cl.
CPC . *B41J 2/03* (2013.01); *B41J 2/09* (2013.01); *B41J 2/175* (2013.01); *B41J 2/18* (2013.01); *B41J 2002/022* (2013.01)

(58) Field of Classification Search
CPC ..... B41J 2/04526; B41J 2/015
See application file for complete search history.

(56) References Cited

U.S. PATENT DOCUMENTS 5,156,303 A * 10/1992 Yamamoto ..... B65D 35/38 222/107
5,156,306 A * 10/1992 Perera ..... B41J 2/02 222/318

(Continued)

FOREIGN PATENT DOCUMENTS

CN 104442011 B 5/2016

OTHER PUBLICATIONS

Preliminary French Search Report for Application No. FR 1753509, dated Dec. 6, 2017.

(Continued)

*Primary Examiner* — Shelby L Fidler
(74) *Attorney, Agent, or Firm* — Pearne & Gordon LLP

(57) ABSTRACT

The invention firstly relates to a print head of a continuous ink jet printer, comprising a first reservoir (12) and a second reservoir (22), arranged on either side of least one jet ejection nozzle (30, $\mathbf{30_1}$-$\mathbf{30_n}$) to which they are connected, and a first actuator (16, $\mathbf{16_1}$-$\mathbf{16_n}$) for applying a $1^{st}$ pressure to the ink of the, or coming from the, $1^{st}$ reservoir, and a second actuator (26, $\mathbf{26_1}$-$\mathbf{26_n}$) for applying a $2^{nd}$ pressure to the ink of the, or coming from the, $2^{nd}$ reservoir, and a controller for controlling these first and second actuators, said controller being programmed to apply a variable difference between these 2 pressures.

20 Claims, 11 Drawing Sheets

(51) Int. Cl.
*B41J 2/14* (2006.01)
*B41J 2/18* (2006.01)

(56) References Cited

U.S. PATENT DOCUMENTS

| | | | | |
|---|---|---|---|---|
| 6,364,470 | B1 * | 4/2002 | Cabal | B41J 2/03 347/82 |
| 7,192,121 | B2 | 3/2007 | Barbet et al. | |
| 2003/0043223 | A1 | 3/2003 | Delametter et al. | |
| 2003/0071880 | A1 * | 4/2003 | Furlani | B41J 2/105 347/82 |
| 2004/0263547 | A1 | 12/2004 | Sugahara | |
| 2008/0018684 | A1 | 1/2008 | Nagashima | |
| 2011/0134174 | A1 * | 6/2011 | Seto | B41J 2/04526 347/10 |
| 2011/0316918 | A1 | 12/2011 | Nagashima | |
| 2017/0173960 | A1 | 6/2017 | Barbet | |
| 2017/0173961 | A1 | 6/2017 | De Saint Romain et al. | |
| 2017/0342292 | A1 | 11/2017 | Barbet et al. | |
| 2018/0065363 | A1 | 3/2018 | Barbet et al. | |

OTHER PUBLICATIONS

European Search Report for application No. EP 18 16 8081 dated Jun. 27, 2018.

* cited by examiner

METHOD AND DEVICE FOR THE HYDRODYNAMIC DEFLECTION OF AN INK JET

CROSS-REFERENCE TO RELATED APPLICATIONS

This application claims priority from French Patent Application No. 17 53509 filed on Apr. 21, 2017. The content of this application is incorporated herein by reference in its entirety.

TECHNICAL FIELD AND PRIOR ART

The invention relates to print heads of printers or printers with continuous deviated ink jets, potentially of the type provided with a multi-nozzle drop generator. It targets in particular a print head or a continuous jet printer in which the sorting of drops is achieved according to a novel principle.

Continuous ink jet (CIJ) printers are well known in the field of industrial encoding and marking of various products, for example for marking bar codes, use-by-dates on food products, or instead references or distance markers on cables or pipes directly on the production line and at high throughput. This type of printer is also found in certain decorative fields where the graphic printing possibilities of the technology are exploited.

These printers have several typical sub-assemblies as shown in FIG. 1.

Firstly, a print head 1, generally remote with respect to the body of the printer 3, is connected thereto by a flexible umbilical 2 grouping together the hydraulic and electrical connections required for the operation of the head while giving it a flexibility that facilitates integration on the production line.

The body of the printer 3 (also called console or cabinet) normally contain three sub-assemblies:

- an ink circuit in the lower part of the console (zone 4'), which makes it possible, on the one hand, to supply ink to the head, at a stable pressure and of a suitable quality and, on the other hand, to take charge of the ink of the jets not used for printing,
- a controller situated in the upper part of the console (zone 5'), capable of generating sequencings of actions and performing treatments enabling the activation of the different functions of the ink circuit and the head. The controller 5 may comprise for example a micro-computer or a microprocessor and/or one (or more) electronic cards and/or at least one embedded software, the programming of which ensures the control of the ink circuit 4 and the print head 1. This controller enables printing instructions to be transmitted to the head and also to control the motors and valves of the system in order to manage the supply of the circuit with ink and/or with solvent as well as the recovery of the mixture of ink and air from the head. It is thus programmed for this purpose,
- an interface 6 which gives the operator the means to implement the printer and to be informed of its operation.

In other words, the cabinet comprises 2 sub-assemblies: in the upper part, the electronics, the electrical supply and the operator interface and, in the lower part, an ink circuit supplying pressurised ink, of nominal quality, to the head and the recovery depression of ink not used by the head.

FIG. 2 schematically represents a print head 1 of a CIJ printer. It comprises a drop generator 60 supplied with electrically conducting ink, pressurised by the ink circuit.

This generator is capable of emitting at least one continuous jet through an orifice of small dimension called nozzle. The jet is transformed into a regular succession of drops of identical size under the action of a periodic stimulation system (not represented) situated upstream of the nozzle outlet. When the drops 7 are not intended for printing, they are directed to a gutter 62 which recovers them in order to recycle unused ink and to send the drops back into the ink circuit. Devices 61 placed along the jet (charge and deflection electrodes) make it possible, on command, to electrically charge the drops and to deflect them in an electric field Ed. They are then deviated from their natural trajectory of ejection from the drop generator. The drops 9 destined for printing escape the gutter and are deposited on the support to print 8.

This description can apply to so-called binary continuous ink jet (CIJ) or multi-deflected continuous jet printers. Binary CIJ printers are equipped with a head of which the drop generator has a multitude of jets, each drop of a jet may only be oriented towards 2 trajectories: printing or recovery. In multi-defected continuous jet printers, each drop of a single jet (or several jets spaced apart) may be deflected on various trajectories corresponding to different charge commands from one drop to the next, thereby realising a scanning of the zone to print along a direction which is the deflection direction, the other direction of scanning of the zone to print is covered by the relative displacement of the print head and the support to print 8. Generally, the elements are laid out in such a way that these 2 directions are substantially perpendicular.

An ink circuit of a continuous ink jet printer makes it possible, on the one hand, to supply regulated pressurised ink, and optionally solvent, to the drop generator of the head 1 and, on the other hand, to create a depression for recovering fluids not used for printing and which next return from the head.

It also enables the management of consumables (distribution of ink and solvent from a reserve) and the control and the maintaining of the quality of the ink (viscosity/concentration).

Finally, other functions are linked to user comfort and the automatic taking in charge of certain maintenance operations in order to guarantee constant operation whatever the conditions of use. These functions include rinsing of the head (drop generator, nozzle, gutter) with solvent, aid to preventive maintenance, for example the replacement of limited lifetime components, notably filters, and/or pumps.

These different functions are activated and sequenced by the controller of the printer which will be all the more complex the greater the number and the greater the sophistication of the functions.

The voltages implemented by the charge and deviation electrodes 61 are high. They may be of the order of a kV, requiring the use of "high voltage" type means. This sorting device thus has manufacturing costs and requires specific maintenance; in addition, it is bulky. Furthermore, the fluid used must be conductive from the electrical viewpoint. And the charge embedded by a drop must be able to be estimated, as well as the shape of the drop itself, the separation of which preferably takes place without satellite drop.

The possibility is also known of realising the deflection of jets using heating means arranged at the outlet of a nozzle, as described for example in the document US 2003/0043223. This technique is complex to implement, because it requires forming, around each nozzle, a heating resistance which goes all round the nozzle. Moreover, the deflection angle obtained is not sufficient to carry out correct sorting of the drops.

The problem is thus posed of finding a novel device and novel methods for performing a sorting of drops, at the outlet of a print head, in a simpler, less expensive and less bulky manner.

DESCRIPTION OF THE INVENTION

The invention firstly relates to a print head of a continuous ink jet printer, comprising a first reservoir and a second reservoir, arranged on either side, preferably symmetrically, with respect to at least one jet ejection nozzle to which they are connected, and first means for applying a $1^{st}$ pressure to the $1^{st}$ reservoir, or to the ink from the, or coming from the, $1^{st}$ reservoir, and second means for applying a $2^{nd}$ pressure to the $2^{nd}$ reservoir, or ink from the, or coming from the, $2^{nd}$ reservoir, the 2 pressures being able to be different to each other, or alternatively equal then different to each other (or the difference between these 2 pressures being variable as a function of time).

The pressure difference between the 2 reservoirs makes it possible to create a specific orientation to a jet produced by the nozzle.

The invention also relates to a print head of a continuous ink jet printer, comprising a reservoir (or a single reservoir), connected to at least one jet ejection nozzle by a channel, the junction between said channel and the nozzle comprising a non-zero radius of curvature, and means for applying a variable pressure to the reservoir, or to the ink from said reservoir, or coming from said reservoir, as a function of time.

Preferably, this radius of curvature $R_c$ is comprised between 0.5 $D_b$ and 1.5 $D_b$, where $D_b$ designates the outlet diameter of the nozzle.

Whatever the embodiment of the invention, a hydrodynamic deflection is thereby first created to then realise a sorting between the drops to print and those which go to recycling.

Such a print head does not require a high voltage applied to a charge electrode, then to a second deviation electrode, such electrodes not being implemented. It does not require, either, a sorting system downstream of the nozzle plate.

Such a print head does not require, either, the implementation of a heating resistance at the outlet of a nozzle.

A device according to the invention is consequently also much more simple than structures known from the prior art.

According to one embodiment, the means for applying a pressure (whether it is a print head according to the invention comprising one, or a single, reservoir, or 2 reservoirs) comprise piezo-electric means, or thermal means, or mechanical means, for applying a $1^{st}$ pressure to the $1^{st}$ reservoir, or to the ink from said $1^{st}$ reservoir, or coming from said $1^{st}$ reservoir, and optionally piezo-electric means, or thermal means, or mechanical means, for applying a $2^{nd}$ pressure to the $2^{nd}$ reservoir or to the ink from said $2^{nd}$ reservoir, or coming from said $2^{nd}$ reservoir.

The activation of these means may be controlled by the controller of the printer.

According to one particular embodiment, these means, for example the piezo-electric means, are arranged on the side of the reservoir(s), or of the print head, in which the nozzle or nozzles emerge, or on the opposite side.

Command means can make it possible to apply (or are provided for, or programmed to apply), successively or alternatively, different pressures to the 2 reservoirs, or to the ink from the, or coming from the, 2 reservoirs, then an identical pressure to the two reservoirs or to the ink from said 2 reservoirs. In the case of a structure with a single reservoir, command means make it possible to apply (or provide for, or be programmed to apply) a variable pressure to this reservoir or to the ink from, or coming from, said reservoir.

Whatever the embodiment considered, the, or each, reservoir may be connected to the nozzle by at least one conduit and/or one chamber.

For example, the, or each, reservoir may be connected to the nozzle by a chamber, then a column, then a conduit.

According to an embodiment, the first means make it possible to apply a $1^{st}$ pressure to the conduit or to the chamber which connects the first reservoir to the nozzle, and/or the second means make it possible to apply a $2^{nd}$ pressure to the conduit or to the chamber which connects the second reservoir to the nozzle.

A print head according to the invention may comprise a plurality of jet ejection nozzles, and means associated with each nozzle, to apply:

- a 1st pressure to a part of the $1^{st}$ reservoir (or to the ink of the, or coming from the, $1^{st}$ reservoir), a $2^{nd}$ pressure to a part of the $2^{nd}$ reservoir (or to the ink of the, or coming from the, $2^{nd}$ reservoir), the 2 pressures being different to each other;
- or (case of an embodiment with one reservoir) for applying a variable pressure to the reservoir or to a part of the reservoir (or to the ink of the, or coming from the, reservoir).

Preferably, the portion of fluid situated at the inlet of a nozzle of diameter $D_b$ has a height Hc, $H_c/D_b$ being comprised between 0.5 and 1.5, which contributes to an efficient deviation of the jet.

Further preferably, the portion of conduit which conveys the fluid situated at the inlet of a nozzle has a curvature.

The invention also relates to an ink jet printer comprising a print head according to the invention, means for supplying ink and/or solvent for this printing, and means for recovering ink not used for printing. Such a print head preferably does not comprise a charge electrode, nor a deviation electrode, such electrodes not being implemented. Preferably it does not comprise, either, a sorting system downstream of the nozzle plate.

The invention also relates to a method for operating a print head of a continuous ink jet printer, as described above and in the rest of this application, thus forming an ink jet with a variable deviation depending on the pressure differences applied to the reservoirs or to their ink or to the ink coming from said reservoirs.

The invention also relates to a method for operating a print head of a continuous ink jet printer, comprising a first reservoir and a second reservoir, arranged preferably symmetrically with respect to a jet ejection nozzle, to which each of the reservoirs is connected.

Different pressures are applied to the 2 reservoirs, or to the ink of these 2 reservoirs or coming from these 2 reservoirs, the pressure difference between both pressures being variable, thereby producing a deviation of the jet of ink that comes out of the nozzle.

The invention also relates to a method for operating a print head of a continuous ink jet printer, comprising a reservoir (or a single reservoir), connected to at least one jet ejection nozzle by a channel, the junction between said channel and the nozzle comprising a non-zero radius of curvature, method in which a pressure variation is applied to the reservoir or to the ink of this reservoir or coming from this reservoir, thereby producing a deviation of the jet of ink that comes out of the nozzle.

According to one embodiment, as already explained above, the different pressures applied to the reservoirs, or the pressure variations applied to the reservoir, are obtained using piezo-electric means or thermal means or mechanical means.

The deviation of the jet may be comprised between 3° and 10°, with respect to the axis of a jet that comes out of the nozzle while being non-deviated.

The output speed of the jet from the nozzle may be of the order of 10 m/s, or comprised between 2 m/s and 15 m/s.

In the case of two reservoirs, after having applied different pressures to the 2 reservoirs, or to the ink of these 2 reservoirs or coming from said 2 reservoirs, it is possible to apply an identical pressure to the two reservoirs, or to the ink of these 2 reservoirs or coming from said 2 reservoirs, thereby producing a non-deviated ink jet.

The embodiment with two reservoirs on either side of a nozzle offers the advantage of being able to make a liquid, for example a cleaning liquid such as solvent, flow from one of the reservoirs to the other without supplying the nozzle and thus without blocking it in the case of transport of large debris (or debris of size comparable to that of the diameter of the nozzle). Unlike in the embodiment with one reservoir, a liquid, for example solvent, is emptied by the nozzle, which can block if large debris (in the above sense) are present.

BRIEF DESCRIPTION OF THE DRAWINGS

An exemplary embodiment of the invention will now be described with reference to the appended drawings in which.

In the figures, similar or identical technical elements are designated by the same reference numbers.

DETAILED DESCRIPTION OF PARTICULAR EMBODIMENTS

Figure 3:
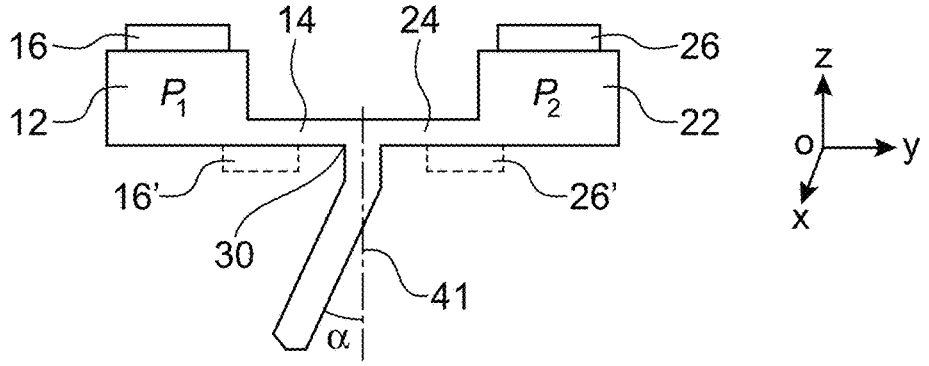
FIG. 3 represents a sectional view of a print head according to one aspect of the invention, the section being made along a plane parallel to the plane YZ and containing the Z axis of a nozzle.
Figure 4:
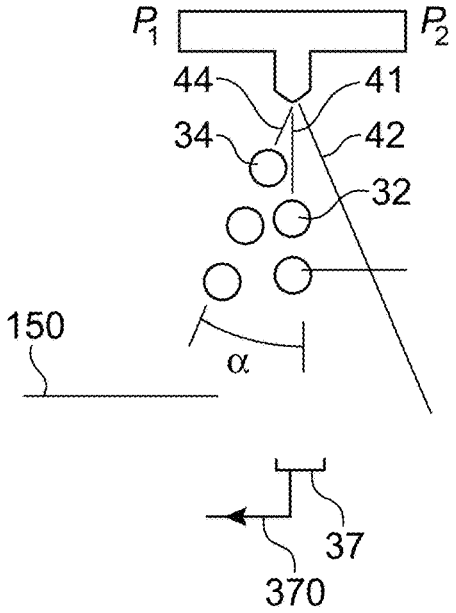
FIG. 4 represents the production and the deviation of drops using a print head having a structure according to FIG. 3.

A structure of an example of a print head according to the invention, and its operation, are represented in FIGS. 3 and 4.

The print head comprises a first and a second reservoir 12, 22 arranged on either side of an axis of flow of an ejection nozzle 30, to which they are each connected by a conduit 14, 24. The two reservoirs are supplied by a circuit for supplying ink, for example of the type described in FR-2954216, from a main reservoir of the printer, using a pump.

Other elements associated with the head may be those described above in relation with FIGS. 1 and 2.

Preferably, the 2 reservoirs and their conduits 14, 24 (or more generally: the fluidic circuits that make it possible to convey the ink from each reservoir to the ejection nozzle 30) are arranged symmetrically (which is the case for the systems represented in the figures and in general for those presented below) and/or are one and the other symmetrical with respect to the axis of flow of the ejection nozzle 30. A plane parallel to the plane OXZ is then a symmetry plane from a geometric and flow viewpoint.

In an alternative (not represented in the figures), the 2 reservoirs are arranged in a dissymmetrical manner with respect to the axis of flow of the ejection nozzle 30. The parameters or the operating conditions, mentioned below or in the present application for a symmetrical structure, and notably the volumes, distances and pressures, are then adapted in order to obtain the desired operation of a dissymmetrical structure.

The direction of flow, inside the conduits 14, 24, is advantageously substantially perpendicular to the axis of flow of the ejection nozzle 30. In an alternative, it is possible to have an inclination of these conduits 14, 24 with respect to this direction perpendicular to the axis of flow of the nozzle.

Under the effect of the pressures in the reservoirs, or in the ink of said reservoirs or coming from said reservoirs, a jet is formed, which may be deviated, or not, from a rectilinear trajectory of which the axis 41 is an axis of symmetry for the ejection nozzle 30. The direction followed by the jet is a function of the difference between the pressures in the 2 reservoirs. The hydrodynamics of the system (in fact: the action of surface tension forces) leads to the formation, from the jet, of drops 32, 34, which could thus be deviated, or not. The deviation is not brought about either by the effect of an electric field on the charges contained in the drops, or by the effect of a heating at the outlet of the nozzle, or by an air flow. In particular, the system does not implement any charge electrode or any deviation electrode to act on the path of the section of ink that comes out of the nozzle 30 or on the drops 32, 34. It does not implement either heating means at the outlet of the nozzle. It does not implement either means for producing an air flow with a view to deviation. The system is thus, compared to known systems, greatly simplified.

A recovery gutter 37 makes it possible to collect the non-deviated drops 32, while the deviated drops 34 will be used for printing on a printing support 150. The gutter is, itself, connected to a hydraulic circuit 370 for recovering ink. According to another embodiment, it is the deviated drops which could be recovered, whereas the non-deviated drops could be used for printing.

P1 designates the pressure in the reservoir 12 or in the ink of said reservoir or coming from said reservoir, and P2 the pressure in the reservoir 22, or in the ink coming of said reservoir or coming from said reservoir.

When P1=P2, the jet formed is not deviated and only drops, of which the trajectory is aligned on the axis 41 of the nozzle, are produced.

When P1≠P2, the jet formed is deviated and only drops, of which the trajectory deviates with respect to the axis of the nozzle, are produced.

When, successively, the pressures satisfy the equality P1=P2, then are different to each other (P1≠P2), the emission of a jet aligned with the axis 41 of the nozzle, then the emission of a jet which deviates with respect to the axis of the nozzle successively take place.

During a certain time t1, it is thus possible to orient the jet in one direction (for printing for example) and during another time t2, the jet is oriented in the other direction to recycle the ink.

More generally, a static pressure is initially applied to the 2 reservoirs, or in the ink of said 2 reservoirs or coming from said reservoirs, which makes it possible to produce a jet, preferably continuous, aligned on the axis 41 of the nozzle. The application of pressure variations to one and/or to the other reservoir is going to make it possible to deviate the jet with respect to its initial trajectory aligned on the axis 41.

According to one particular embodiment, the pressures and their variations in each of the reservoirs, or in the ink of said 2 reservoirs or coming from said reservoirs, may be produced by piezo-electric means or actuators or stimulators 16 (16'), 26 (or 26'), comprising a piezoelectric ceramics. An actuator or a stimulator of this type may be controlled:

- with activation voltages of the order of several tens of volts, for example comprised between 5 V and 50 V;
- and/or with one or more high frequency or frequencies, comprised for example between 50 kHz and 500 kHz; in comparison, the frequencies obtained using electromagnetic valves reach at best 1 kHz.

As illustrated in FIG. 3, piezo-electric actuators 16 (or 16') are formed above the upper wall of the reservoir 12 (or below the reservoir 12 and optionally the channel 14) whereas the piezo-electric actuators 26 (or 26') are formed above the upper wall of the reservoir 22 (or below the reservoir 22 and optionally the channel 24).

Figure 5:
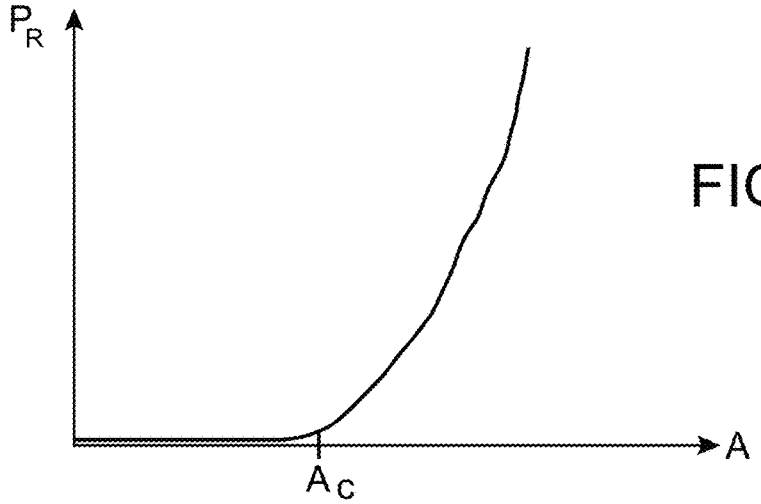
FIG. 5 represents the change in the pressure generated by piezo-electric means as a function of the amplitude of the oscillation applied to these means.

The pressure generated by each of the piezo-electric actuators follows a curve, as a function of the amplitude of the oscillation applied to these means, which is illustrated in FIG. 5: below a certain critical threshold Ac of the amplitude, the pressure varies little and remains stable (in fact, for $A<A_C$, the relationship between A and $P_R$ is increasing, but with a slope that is gentle, not visible in FIG. 5). Above this threshold, a non-linear regime appears and the pressure increases as a function of the amplitude A.

Consequently, by applying oscillations of different amplitudes to the actuators 16 (16'), 26 (26'), it is possible to generate pressure differences, for example between the two reservoirs. For example, the piezo-electric actuators 16 are preferably activated in such a way as to go beyond the threshold Ac of appearance of the non-linear regime, whereas the piezo-electric actuators 26 are activated in such a way as to remain below this threshold. This operating mode, which exploits the passage into non-linear mode of the activated piezo-electric actuators 16 (16'), 26 (26') is preferred for the implementation of these actuators because it makes it possible to accentuate the effect that results from the application of voltages to these same actuators.

It is thus possible, by this system, to produce a pressure difference between the reservoirs, or between the ink of said 2 reservoirs or coming from said reservoirs, which leads to a deviation of the jet formed at the outlet of the nozzle.

To reinforce the effect, the actuator, or each piezo-electric element can work at its resonance frequency, which is preferable to favour a greater deformation amplitude.

In an alternative, whether it is the present embodiment or those that are described below, each of the actuators 16, 16', 26, 26', may be:

- thermal activation means or actuator; for example, an electrical resistance is arranged at the location where it is wished to heat, for example on the path of the ink between the reservoir and the nozzle 30;
- or a capacitor or means forming a capacitor, in the air gap of which the zone is positioned in which it is wished to heat the ink (heating of volumic type, exploiting the fact that the ink is resistive). In a another embodiment, whether it is the present embodiment or those that are described below, it is possible to implement a mechanical actuator or means, the ink being, at the location where it is wished to apply a pressure to it, for example in a flexible part or portion and means, for example forming a pincer or a vice, making it possible to apply to this flexible part or portion pulses for tightening then untightening them.

In the rest of this description, means (for applying a pressure) can be understood as actuator (for applying a pressure).

Whatever the embodiment, the $1^{st}$ means for applying pressures to the $1^{st}$ reservoir 12, or to the ink of said $1^{st}$ reservoir or coming from said reservoir, are different from the $2^{nd}$ means for applying pressures to the $2^{nd}$ reservoir 22, or to the ink of said $2^{nd}$ reservoir or coming from said reservoir, so different pressures can be applied to said two reservoirs or to their ink (or to the ink coming from said reservoirs) and that a pressure difference between reservoir 12 and reservoir 22 or between their ink (or to the ink coming from said reservoirs) can be variable. As illustrated in FIG. 4, the activation of the means 16 (16'), while the means 26 are not activated, leads to a deviation of the jet along the direction 44; conversely, the activation of the means 26 (26'), while the means 16 (16') are not activated, leads to a deviation of the jet along the direction 42. In both cases, the activation signifies the application of an oscillation of amplitude greater than the threshold Ac for triggering the non-linear regime.

The invention makes it possible to deviate a jet, with respect to the axis 41 of the nozzle, by an angle which may be of the order of several degrees, for example comprised between 3° and 10°. This is sufficient for an application to a continuous ink jet printer.

Figure 6A:
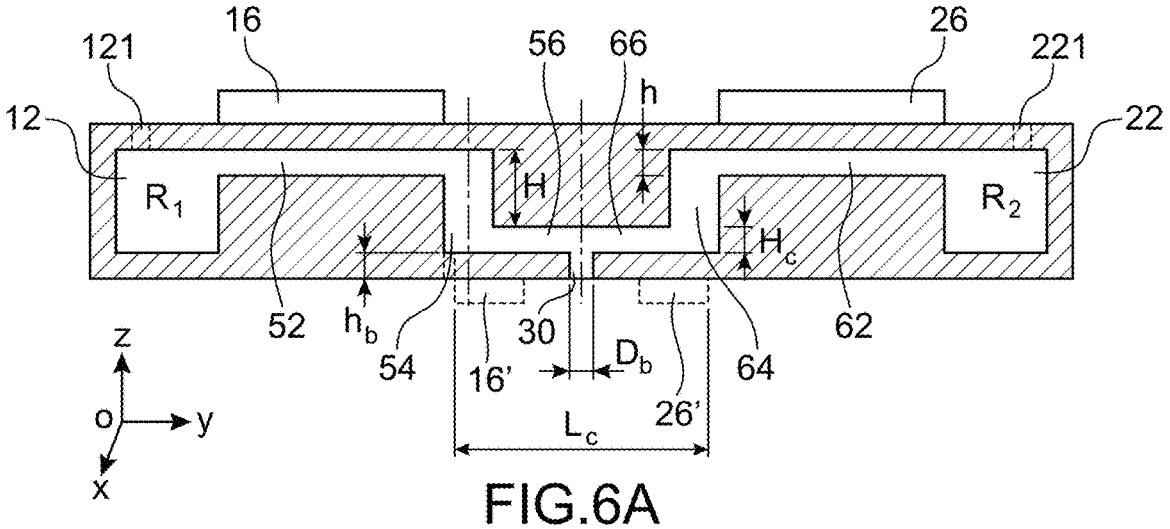
FIGS. 6A and 6B represent a sectional view and a top view of another print head according to the invention.
Figure 6B:
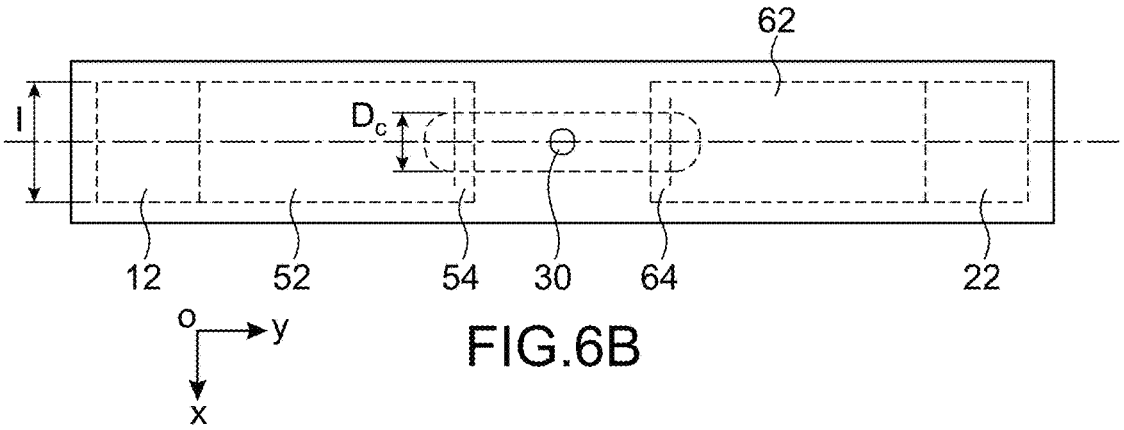

Another example of print head structure is illustrated in FIGS. 6A and 6B. FIG. 6A is a sectional view of this structure, realised along a plane parallel to the plane OYZ of a tri-rectangular marker OXYZ, the X axis being directed perpendicularly to the figure.

The references 12 and 22 further designate the 2 reservoirs in which two chambers 52, 62 emerge, oriented along a plane parallel to the plane OXY. Each of these chambers has for example:

- a length L (measured along the Y axis) comprised between 400 μm and 4 mm;
- and/or a depth l (measured along the X axis) comprised between 200 μm and 1 mm;
- and/or a height h (measured along the Z axis) comprised between 100 μm and 50 μm. Piezo-electric means 16, 26 may be formed above the upper wall of the chamber 52, 62, with a view to creating pressure variations which make it possible to deviate the jet, as explained above in relation with FIGS. 3-5 (in this figure and the following figures, means 16', 26' are also mentioned in the lower part of the device; reference will not systematically be made to this alternative hereafter, but it should be understood that it is covered by the different structures described below). The pressures are thus here applied to the ink from each of the reservoirs. Each reservoir may be supplied, from the outside, via a conduit 121, 221.

Each of these chambers is followed by a cylindrical column 54, 64, of height $H+H_c$ (this column is directed along the Z axis), connected to the corresponding chamber 52, 62 by a $1^{st}$ bend.

Finally, a conduit 56, 66 (directed parallel to the Y axis), of height $H_c$, connects each cylindrical column 54, 64 with the inlet orifice of the nozzle 30, of length $h_b$ (this length being measured along the Z axis or along the axis of flow 41). This conduit 56, 66 is itself also connected to the corresponding cylindrical column by a $2^{nd}$ bend.

The nozzle 30 has a diameter $D_b$ (measured in the plane OXY, that is to say in a plane that extends perpendicularly to the Z axis or to the axis 41) for example comprised between several 10 μm and 100 μm.

Preferably, $H_c$/Db is comprised between 0.5 and 1.5: this condition allows the fluid to be rerouted (or instead: allows the flow of the fluid to be deviated from the plane OXY to the axis 41 or to the Z axis) in a satisfactory manner when it passes from the conduits 56 or 66 to the nozzle 30. The fluid is deviated with a 90° angle when passing from the conduit 56, 66 to the nozzle 30; this curvature of the flow lines of the ink amplifies any pressure difference between the ink flow on both side of the nozzle and contributes to a very favourable deviation of the jet. It has to be noted that a continuous jet is indeed difficult to deviate due to its kinetic energy and/or its inertia (it is much more difficult to deviate than individual droplets); a ratio $H_c$/Db comprised between 0.5 and 1.5 is very favourable to such deviation.

In FIG. 6B is represented a top view of the structure of FIG. 6A. As may be seen in this FIG. 6B, the reservoirs 12, 22 and the chambers 52, 62 have a same depth along the X axis. In this figure, a single nozzle 30 arranged between the two reservoirs and all of the means 50, 56, 62, 66 have been represented which make it possible to convey the ink from these reservoirs to the nozzle 30.

Figure 7:
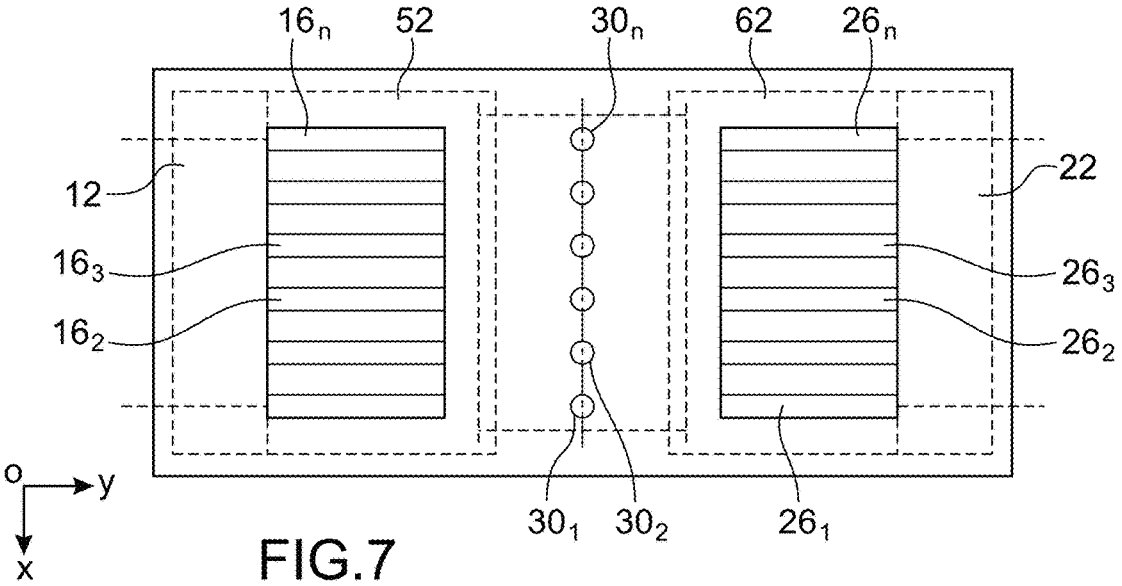
FIG. 7 represents a top view of an alternative of a print head according to FIGS. 6A and 6B, FIGS. 8A and 8B represent a sectional view and a top view of another print head according to the invention, FIG. 8C represent a sectional view of a print head according to the invention, together with ink supply reservoirs.

FIG. 7 is another top view of an alternative of the preceding structure, of which the section, along a plane OYZ, is identical to that of FIG. 6A; according to this alternative, it is also possible to have a plurality of nozzles $\mathbf{30}_1$, $\mathbf{30}_2$, . . . $\mathbf{30}_n$ (for example: n=2 or 8, or 16, or 32, or 64 . . . ) aligned along an axis parallel to the X axis. Here, again, on each side of a plane of symmetry which passes through the orifices of the nozzles $\mathbf{30}_1$-$\mathbf{30}_n$ and which are parallel to the plane OXZ, a single reservoir 12, 22, emerges in the chamber 52, 62, which emerges in the corresponding conduit 56, 66.

In the structure of FIG. 7, piezo-electric means (or thermal activation means or mechanical activation means, as already described above) $\mathbf{16}_1$, $\mathbf{16}_2$, $\mathbf{16}_3$ . . . , $\mathbf{16}_n$, $\mathbf{26}_1$, $\mathbf{26}_2$, $\mathbf{26}_3$ . . . , $\mathbf{26}_n$, may be formed above the upper wall of the chamber 52, 62, a pair of piezo-electric means $\mathbf{16}_i$, $\mathbf{26}_i$ being associated with the nozzle $\mathbf{30}_i$, the means $\mathbf{16}_i$, $\mathbf{26}_i$ being arranged on either side thereof, to activate the portion of the chamber 52, 62 which leads to said nozzle, substantially along an axis parallel to OY. There is thus, along the axis OX, on the one hand, a succession of piezo-electric means $\mathbf{16}_1$, $\mathbf{16}_2$, $\mathbf{16}_3$ . . . , $\mathbf{16}_n$, and, on the other hand, a succession of piezo-electric means $\mathbf{26}_1$, $\mathbf{26}_2$, $\mathbf{26}_3$ . . . , $\mathbf{26}_n$.

Figure 8A:
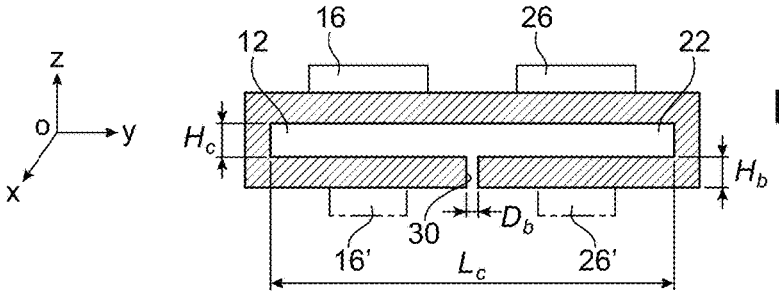
Figure 8B:
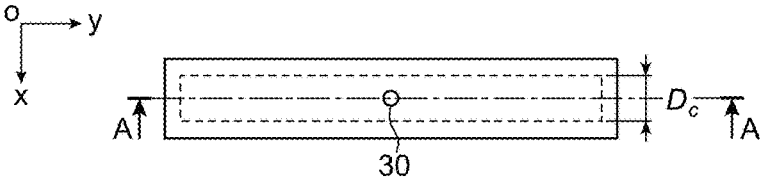

Another print head structure according to the invention is illustrated in FIGS. 8A and 8B. FIG. 8A is a sectional view of this structure, made along a plane parallel to the plane OYZ of a tri-rectangular mark OXYZ, the X axis being directed perpendicularly to the figure.

The references 12 and 22 further designate the 2 reservoirs that emerge directly on the nozzle 30. Piezo-electric means 16, 26 may be formed above the upper wall of each reservoir, with a view to realising the pressure variations which make it possible to deviate the jet, as explained above in relation with FIGS. 3-5.

Each reservoir has a height $H_c$. The nozzle 30 has a diameter $D_b$ for example comprised between several 10 μm and 100 μm.

Preferably, $H_c/D_b$ is comprised between 0.5 and 1.5: this condition enables the fluid to be rerouted in a satisfactory manner when it passes from the reservoir 12, 22 to the nozzle 30. The reasons and the advantages are the same as explained above (this ratio between the above limits is very favourable to a deviation of the fluid with a 90° angle when passing from the conduit 56, 66 to the nozzle 30; this curvature of 90° of the flow lines of the ink amplifies any pressure difference between the ink flow on both side of the nozzle and contributes to a very favourable deviation of the jet).

In FIG. 8B is represented a top view of the structure of FIG. 8A. As may be seen in this FIG. 8B, the reservoirs 12, 22 have a same depth along the X axis. In this figure, a single nozzle 30 arranged between the two reservoirs has been represented.

Figure 9A:
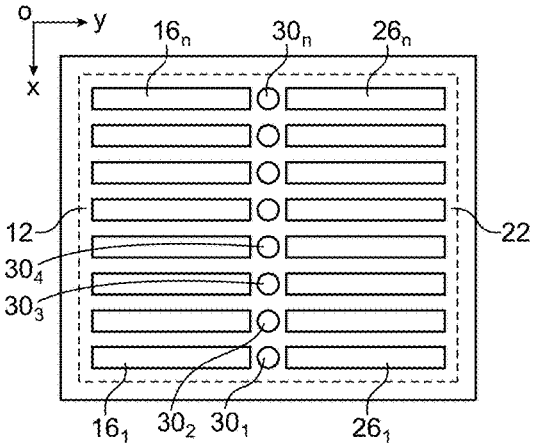
FIG. 9A represents a top view of an alternative of a print head according to FIGS. 8A and 8B.

But, as illustrated in FIG. 9A, which is another top view of a structure of which the section, along a plane OYZ, is identical to that of FIG. 8A, it is also possible to have a plurality of nozzles $\mathbf{30}_1$, $\mathbf{30}_2$, . . . $\mathbf{30}_n$ (for example: n=8, or 16, or 32, or 64 . . . ) aligned along an axis parallel to the X axis. Here, again, there is a single reservoir 12, 22 on each side of the axis along which the nozzles $\mathbf{30}_1$-$\mathbf{30}_n$ are aligned. The whole of the device thus has a symmetry with respect to a plane parallel to OXZ and which passes via the axis along which the nozzles are aligned.

In the structure of FIG. 9A, piezo-electric means $\mathbf{16}_1$, $\mathbf{16}_2$, $\mathbf{16}_3$ . . . , $\mathbf{16}_n$, $\mathbf{26}_1$, $\mathbf{26}_2$, $\mathbf{26}_3$ . . . , $\mathbf{26}_n$, may be formed above the upper wall of each reservoir 12, 22, a pair of piezo-electric means $\mathbf{16}_i$, $\mathbf{26}_i$ being associated with the nozzle $\mathbf{30}_i$, the means $\mathbf{16}_i$, $\mathbf{26}_i$ being arranged on either side thereof, to activate the portion of each reservoir 12, 22 which leads to said nozzle, substantially along an axis parallel to OY.

Here again, each reservoir has a height $H_c$, each nozzle having a diameter $D_b$ for example comprised between several 10 μm and 100 μm; preferably, $H_c/D_b$ is comprised between 0.5 and 1.5, with the same technical reasons and advantages already mentioned above.

Figure 8C:
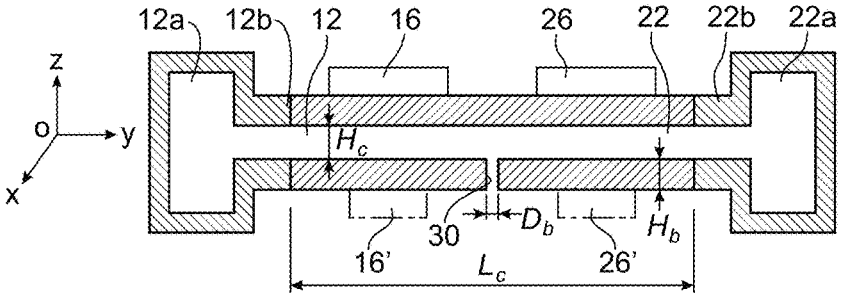

FIG. 8C, respectively 9B, show the same device as on FIG. 8A, respectively 9A, together with ink supply reservoirs 12*a*, 22*a*, each connected to one of the reservoirs 12, 22, for example through a hydraulic circuit or conduit or duct 12*b*, 22*b* (FIG. 8C). On FIG. 9B, each of the reservoir 12*a*, 22*a* is connected to one of the reservoirs 12, 22 through a plurality of openings or orifices arranged along a direction parallel to the direction of extension the plurality of nozzles $\mathbf{30}_i$.

Figure 9B:
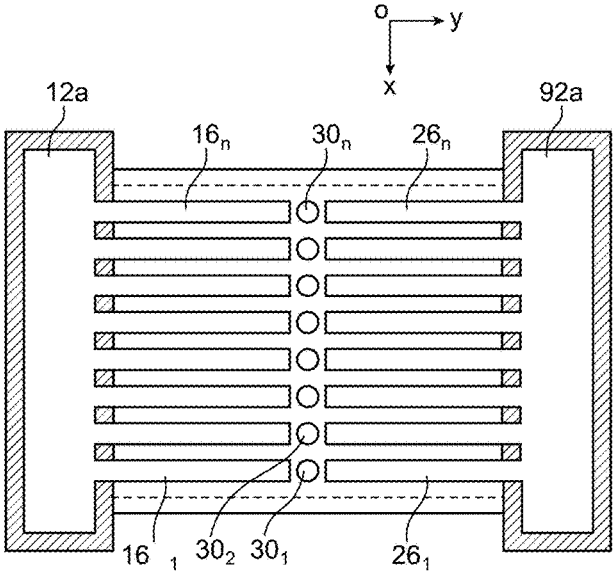
FIG. 9B represents a top view of an alternative of a print head according to FIGS. 8A and 8B, together with ink supply reservoirs.

On FIG. 9B a plurality of hydraulic circuits or conduits or ducts similar to 12*b*, 22*b* could connect each of the ink supply reservoirs 12*a*, 22*a* to the reservoirs 12, 22. Preferably, each of the hydraulic circuit or conduit or duct 12*b*, 22*b* has an internal diameter which forms a restriction so that ink cannot flow back from the reservoirs 12, 22 to the ink supply reservoirs 12*a*, 22*a*.

Same or similar ink supply reservoir(s) 12*a*, 22*a* could be connected to the reservoirs 12, 22 of FIG. 3, 4 or 6A-7, or to the reservoir 12 of FIG. 11A-12A, 14A-14G or 6A-7, possibly with same or similar hydraulic circuit(s) or conduits or ducts 12*b*, 22*b*, also preferably forming a restriction as explained above.

In the above embodiments, the piezo-electric activation means 16, 26 are represented above each of the reservoirs 12, 22 or above the chambers 52, 62 or above the print head. In an alternative, these means may be arranged on the opposite side, for example under conduits 56, 66, as represented in dotted lines in FIGS. 3, 6A, 8A. The thickness of the lower wall, on which the corresponding means are positioned, is adapted to the presence of these means.

Figure 10A:
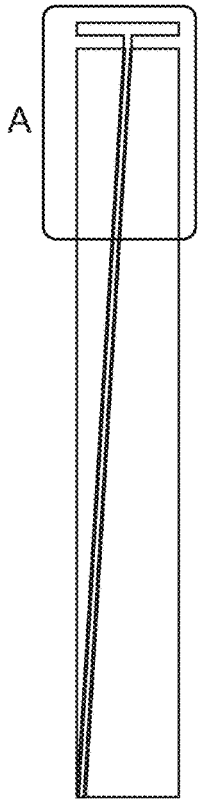
FIGS. 10A-10C and 11A-11B represent simulation and test results for a print head according to the invention.
Figure 10B:
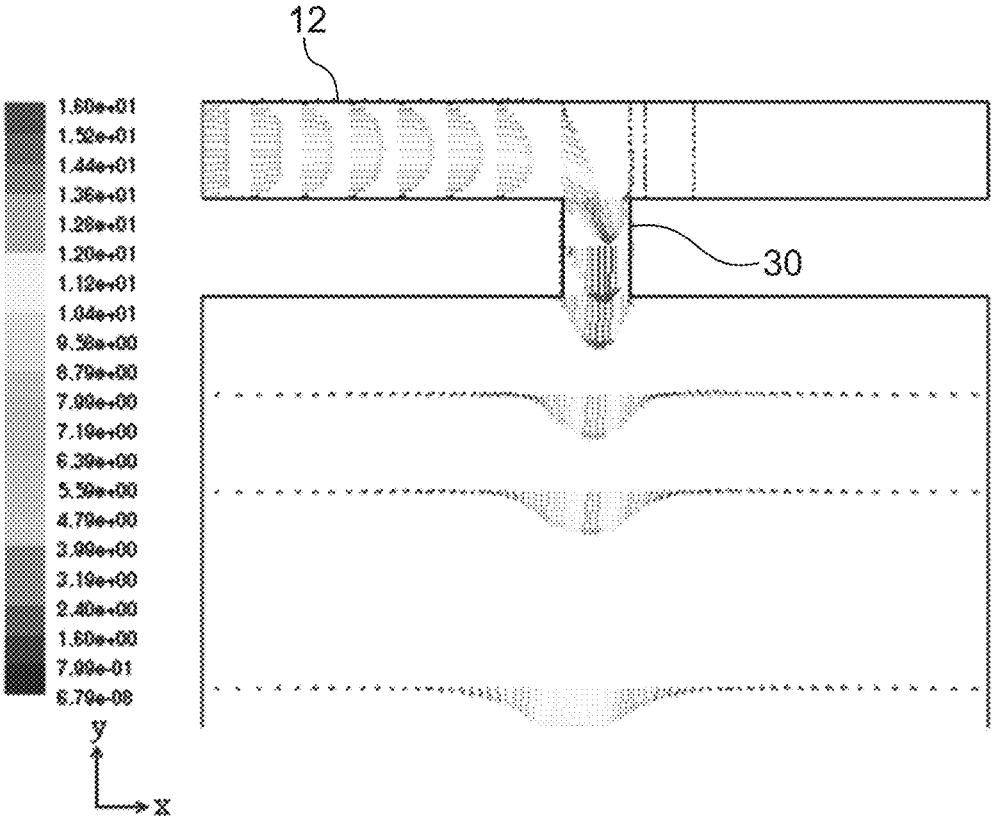
Figure 10C:
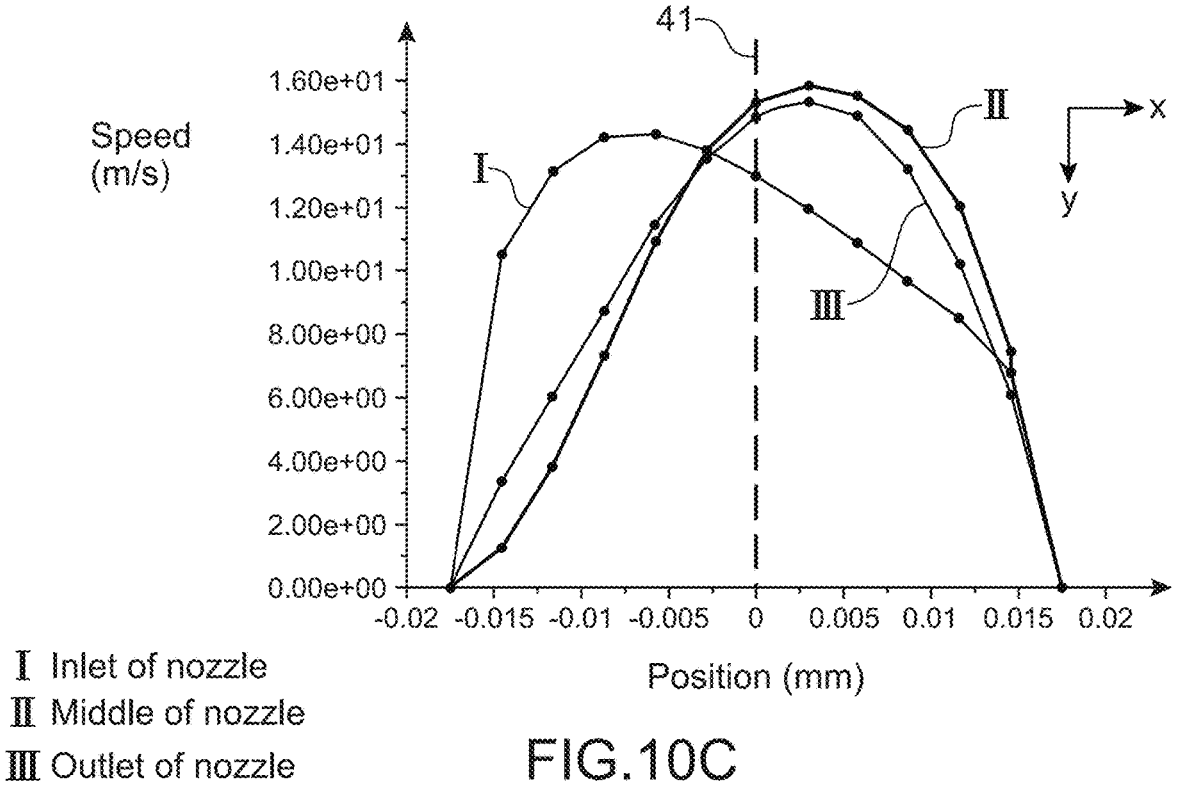

From the structure of FIGS. 8A and 8B, a simulation has been performed, the result of which is illustrated schematically in FIGS. 10A-10C.

The reservoir 12 is pressurised (2 to 3 bars), the reservoir 22 is closed. The nozzle 30 is the only outlet of the ink. The jet flows from the nozzle, in air under atmospheric pressure, with an average speed $v_b$=10 m/s.

In FIG. 10A is represented the state of a jet that comes out of the nozzle 30 when the pressures between the two reservoirs 12, 22 are not identical. It is thus actually possible to obtain a deviation of the jet, with an angle of deviation, between the direction of flow of the deviated jet and the axis 41 of the nozzle 30, of several degrees, as explained above in relation with FIGS. 3-5.

In FIG. 10B are represented speed profiles in the reservoir 12 (the reservoir 22 being closed), then in the nozzle 30 and in air, at the outlet of the nozzle. A parabolic profile of the speed in the reservoir is observed. The speed of the jet in air (around 10 m/s) is slightly less than its value at the outlet of the nozzle. This difference is among other things due to air drag. Moreover, it may also be clearly seen that the speed profile is progressively deviated to the left part of the figure.

FIG. 10C represents curves which give, as a function of the distance with respect to the axis 41 of the nozzle, the speed of the ink at the inlet of the nozzle 30 (curve I), in the middle of the nozzle (curve II), and at the outlet of the nozzle (curve III).

The dissymmetry of curve I with respect to the axis 41 of the nozzle reflects the fact that the pressure in one of the reservoirs is greater than the pressure in the other reservoir. The result is, at the outlet of the nozzle 30, a non-symmetrical speed profile with respect to the axis of the nozzle (curve III), which results in a deflection of the jet. A perfectly parabolic speed profile at the inlet of the nozzle 30 would give rise to a jet aligned on the hydraulic axis 41 of the nozzle.

The angle of deflection of the jet is around 3.25° for a jet speed, at the nozzle outlet, of around 10 m/s.

Figure 11A:
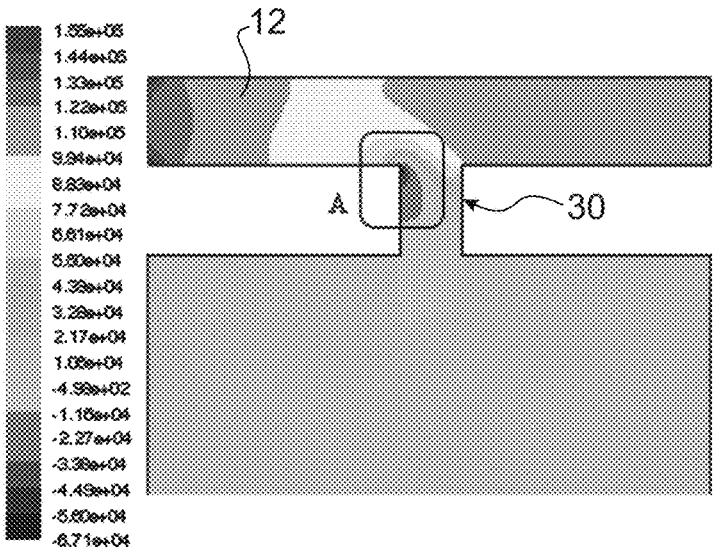
Figure 11B:
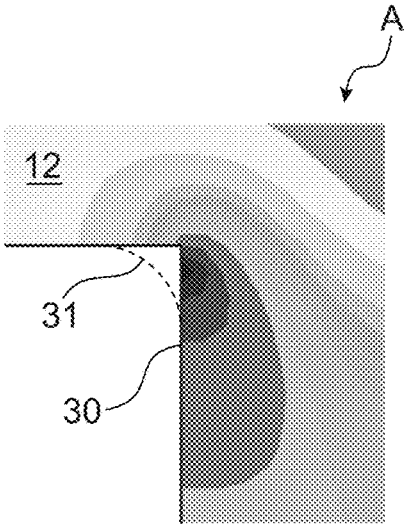

Another aspect of the invention is illustrated in FIGS. 11A and 11B, the latter being an enlargement of a part of FIG. 11A. These figures show the static pressure field of the structure of FIGS. 8A and 8B, in the conditions already mentioned above in relation with FIGS. 10A-10B. It may be seen in these figures that the pressure progressively diminishes in the conduit and becomes practically zero in air. In the angular zone designated by the letter A, which corresponds to the zone where the reservoir 12 joins the nozzle 30, the pressure is negative. This zone may thus be subject to cavitation phenomena, sources of instability of the jet. To limit this problem, it is preferable to produce a junction, between the cavity 12 and the inlet of the nozzle 30, which has a non-zero radius of curvature (the centre of curvature being situated on the external side of the device, and not on the side of the reservoir 12), as illustrated with the broken line 31 in FIG. 11B. This result, presented in the framework of a particular structure (FIG. 12A) is transposable to each of the other structures (FIGS. 3, 6A-6B, 7, 8A, 8B: in these other structures, the junction between, on the one hand, the channels 14, 24 or 56, 66, or the reservoir 12, 22 and, on the other hand, the nozzle 30, may thus also have a non-zero radius of curvature, with the same advantages as those that are described here).

Figure 12A:
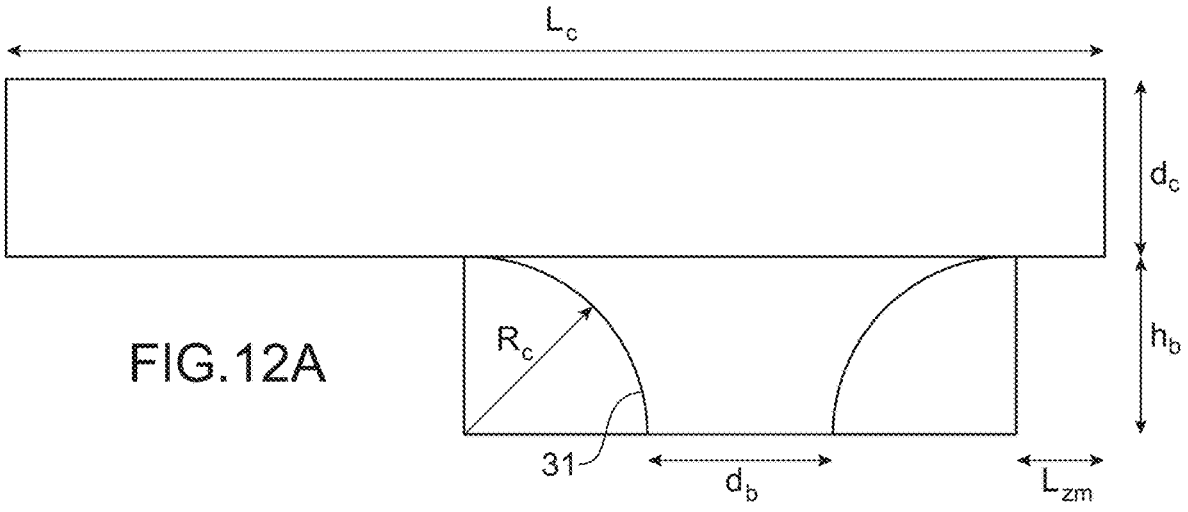
FIGS. 12A-12B represent other aspects relative to a print head according to the invention.

According to an exemplary embodiment, the structure of FIG. 12A has the following geometric characteristics:

$L_c$=125 μm (length of the conduit);

$d_c$=50 μm (height of the conduit);

$h_b$=50 μm (height of the nozzle);

$d_b$=50 μm (diameter of the nozzle);

$L_{zm}$=15 μm (length of the dead zone).

Figure 12B:
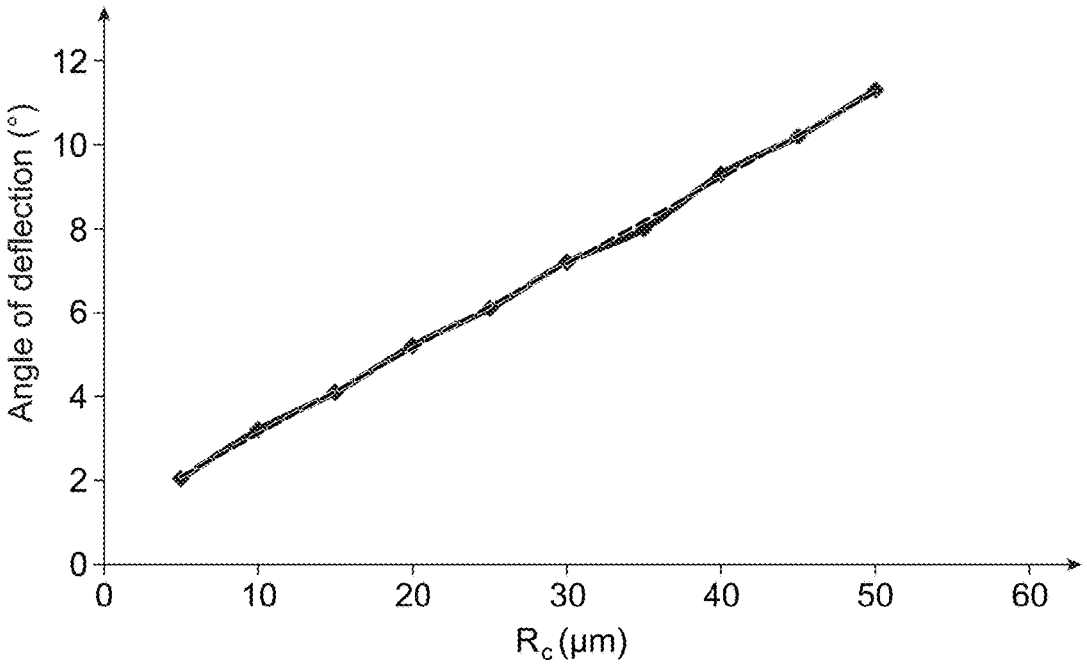

For a structure such as that of FIG. 12A, FIG. 12B shows the angle of deflection as a function of the radius $R_c$ of curvature of the part 31 of the nozzle for an alternative in which the nozzle is only supplied on one side. The ink has a density p of 870 kg/m$^3$, a viscosity μ=0.004 Pa·s, a surface tension σ=0.023 N/m, the properties of air being a density ρ of 1.2 kg/m$^3$ and a viscosity μ=0.001 Pa·s.

By varying the value of the inlet speed in the nozzle (for example successively of 2 and 8 m/s), the continuous ink jet allows two directions separated by an angle of 8.5°. The continuous jet at 8 m/s has an angle of 8.5° with respect to the geometric axis of the nozzle (see FIG. 13A). The speed transition to 2 m/s for a duration of 100 μs makes it possible to form a drop with a direction practically merged with that of the hydraulic axis of the nozzle.

One targeted objective is to be able to sort drops intermittently, that is to say, during a certain time, orienting the jet in one direction (to print, for example) and, during another time, orienting the jet in the other direction (for example to recycle the ink).

To obtain drops from a continuous jet, the jet is broken up into portions of not too long jets which end up becoming drops under the action of surface tension.

An example of method implemented with the structure of FIG. 12A, may be the following:

- A jet of ink is ejected at a speed of 8 m/s continuously; This jet is deviated and collected by a gutter (not represented);
- The ejection speed is reduced for a duration of 100 μs, the jet then being substantially in the axis of the nozzle;
- A new jet is ejected with a speed of 8 m/s while being deviated.

Figure 13A:
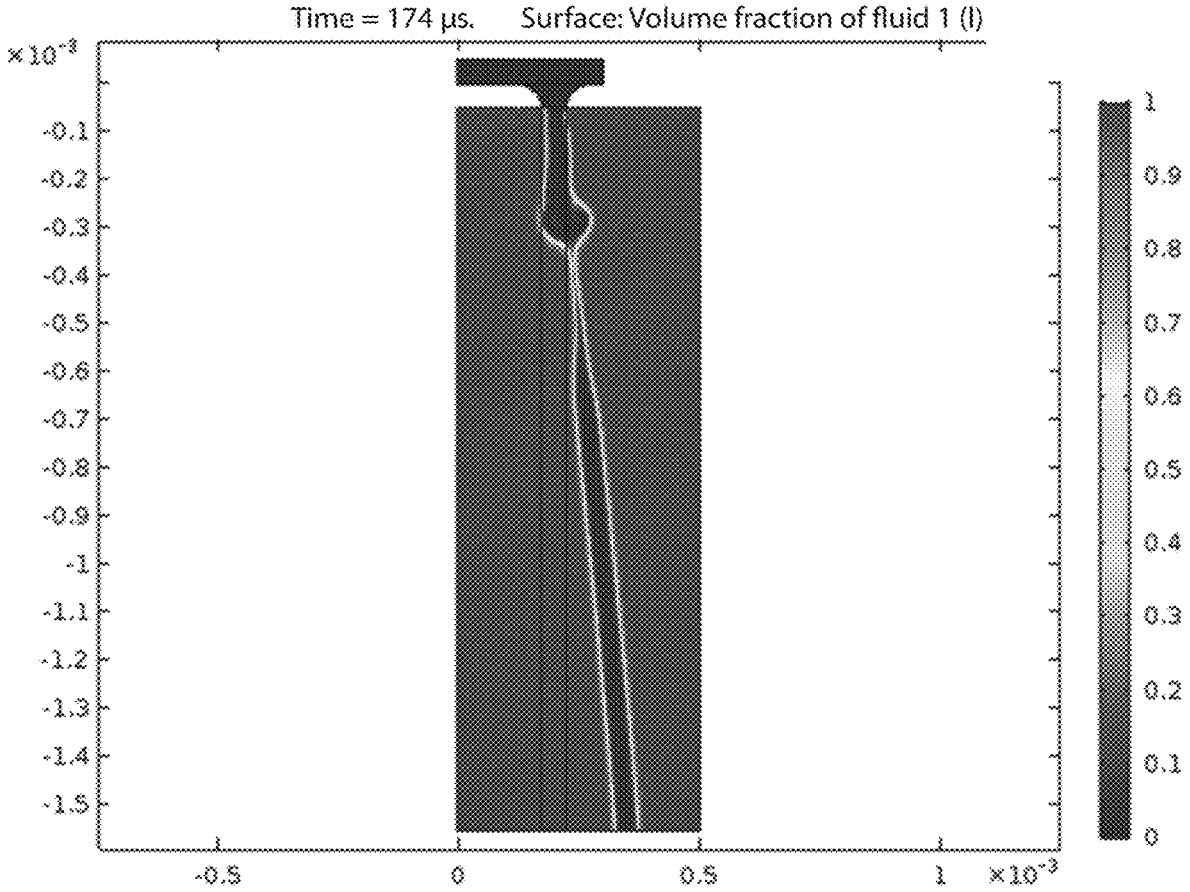
FIGS. 13A and 13B represent other simulation results for a print head according to the invention.

Modelling, illustrated in FIG. 13A (the structure is that of FIG. 12A), has made it possible to a put a figure to an angle of the hydrodynamic deflection of the jet of 8.25°. At a distance of 5 mm from the outlet of the nozzle, the differential deflection is typically 750 μm which makes it possible to place easily a gutter beak to collect the continuous jet and to allow to pass onto the printing support the drop (intermittent) formed in the continuous jet.

Figure 13B:
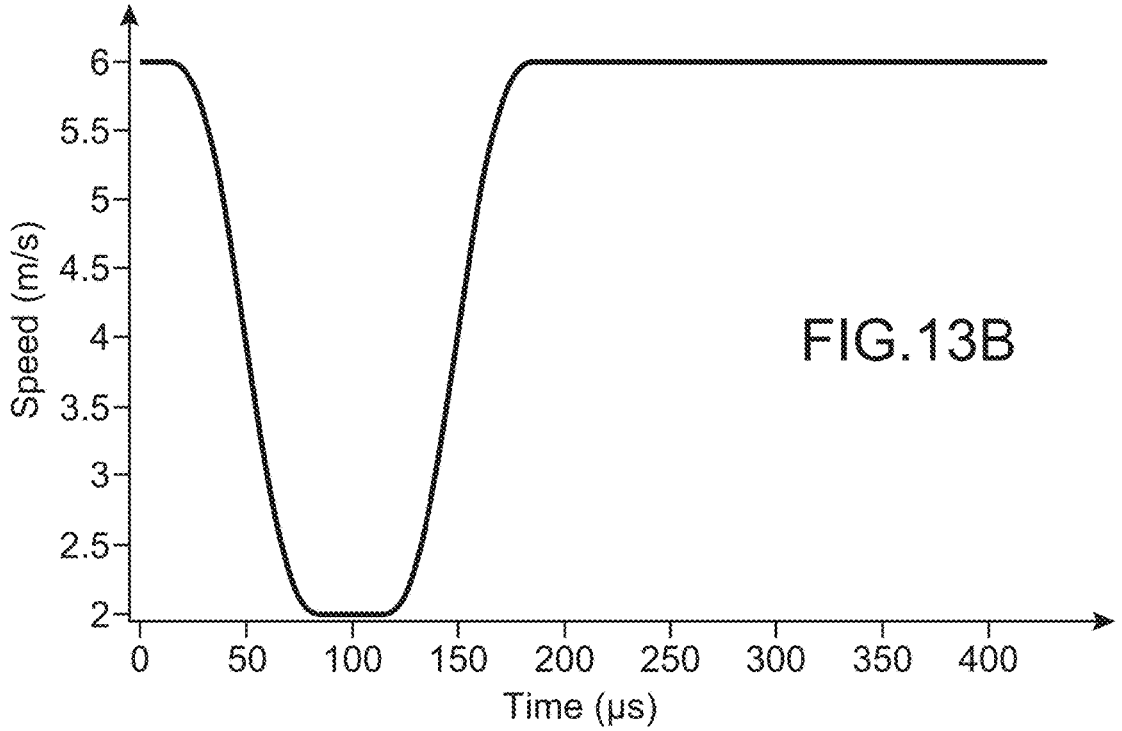

FIG. 13B represents an example of speed variation as a function of time to obtain an effect as described above. The maximum speed is here around 6 m/s then is greatly reduced for around 100 μs.

As explained above, a structure such as that of FIG. 12A, comprising a radius $R_c$ of curvature of the part 31 of the nozzle may be applied to an alternative in which the nozzle is only supplied on one side.

Figure 14A:
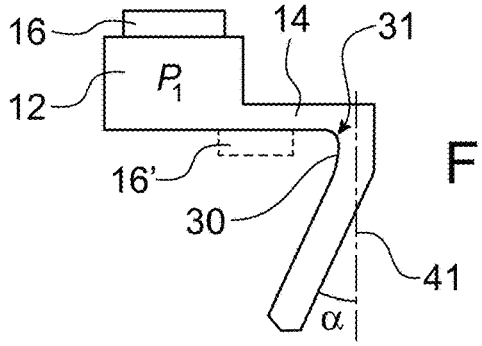
FIG. 14A represents a sectional view of a print head according to another aspect of the invention, the section being made along a plane parallel to the plane YZ and containing the Z axis of a nozzle.
Figure 14B:
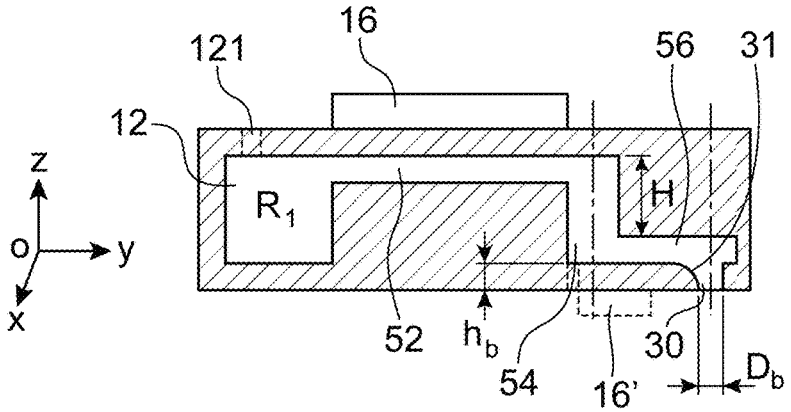
FIGS. 14B-14G represent sectional and top views of other embodiments of a print head according to the invention.
Figure 14C:
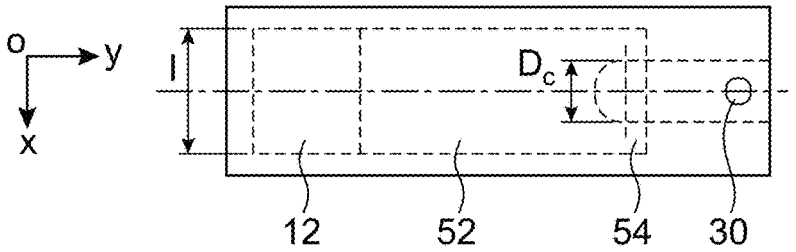
Figure 14D:
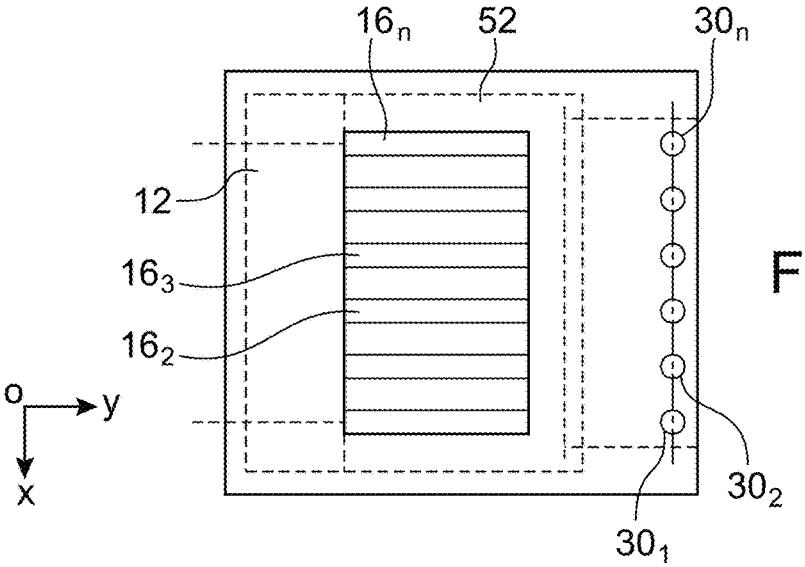
Figure 14E:
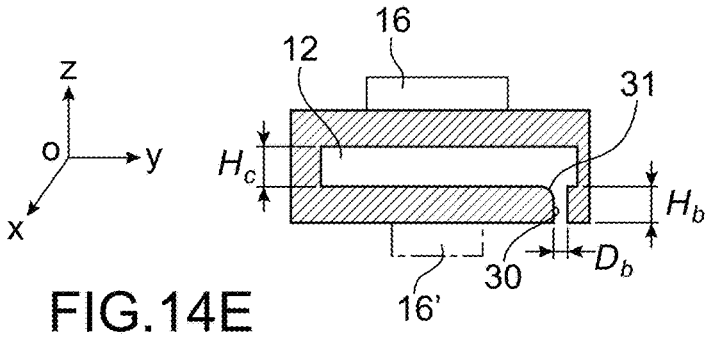
Figure 14F:
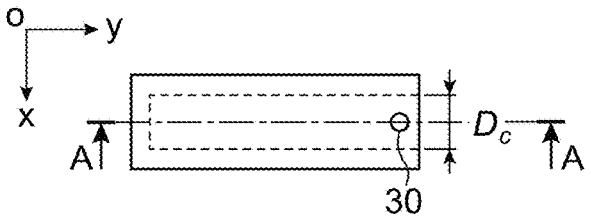
Figure 14G:
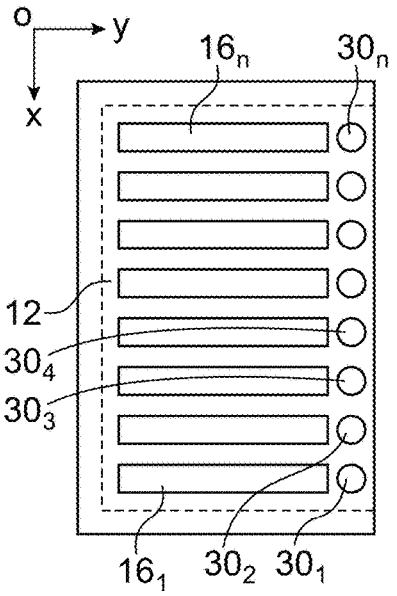
Figure 15:
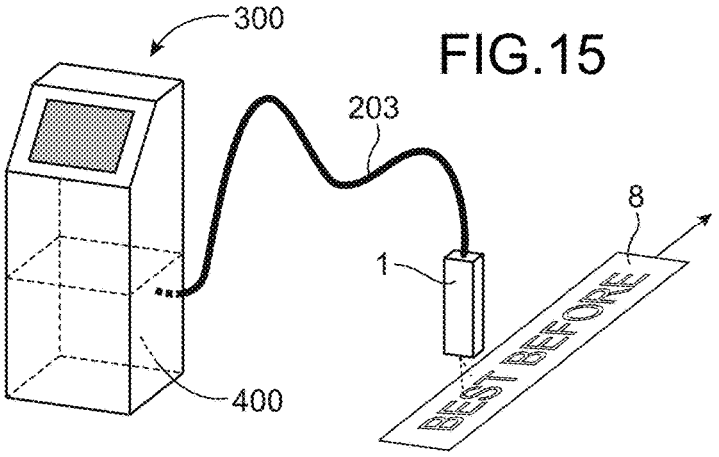
FIG. 15 represents a structure of an ink jet printer to which the present invention may be applied.

Thus the structure illustrated in FIG. 14A, which only comprises one reservoir 12, also makes it possible to perform a deviation of a jet as a function of the pressure in this reservoir.

In this embodiment, the print head only comprises one reservoir 12 and one ejection nozzle 30, which are connected together by a conduit 14, which preferably has a direction of flow substantially perpendicular to the natural axis of flow of the nozzle 30. The reservoir is supplied by a circuit for supplying ink, for example of the type described in FR-2954216, from a main reservoir of the printer, using a pump.

Other elements associated with the head may be those described above in relation with FIGS. 1 and 2 (however, preferably without charge electrode, and without deviation electrode, such electrodes not being necessary since deviation is achieved as explained above, with help of pressure differences. A sorting system downstream of the nozzle plate is also not necessary).

The junction 31 between the nozzle 30 and the conduit 14 has a non-zero radius of curvature, the centre of curvature of which is situated on the external side of the device, and not on the side of the conduit 14.

Under the effect of pressure variations in the reservoir 12, a jet is formed, which may be deviated, or not, from a rectilinear trajectory of which the axis 41 is an axis of symmetry for the ejection nozzle 30. The direction followed by the jet is a function of the pressure in the reservoir 12. The hydrodynamics of the system (in fact: the action of surface tension forces) leads to the formation, from the jet, of drops which could thus be deviated, or not. Here again, the deviation is not brought about either by the effect of an electric field on the charges contained in the drops, or by the effect of a heating at the outlet of the nozzle, or by an air flow. In particular, the system does not implement any charge electrode or any deviation electrode to act on the path of the section of ink that comes out of the nozzle 30 or on the drops. It does not implement either heating means at the outlet of the nozzle. It does not implement either means for producing an air flow with a view to deviation. The system is thus, compared to known systems, greatly simplified.

In a similar manner to what has been described above in relation with FIG. 4, a recovery gutter 37 makes it possible to collect non-deviated drops, whereas deviated drops will be used for printing on a printing support. The gutter is, itself, connected to a hydraulic circuit 370 for recovering ink. According to another embodiment, it is deviated drops that could be recovered, whereas non-deviated drops could be used for printing.

During a certain time t1, it is thus possible to orient the jet in a direction (to print for example) and during another time t2, the jet is oriented in the other direction to recycle the ink.

More generally, a static pressure is initially applied to the reservoir 12, which makes it possible to produce a jet, preferably continuous, aligned on the axis 41 of the nozzle. The application of a pressure variation is going to make it possible to deviate the jet with respect to its initial trajectory aligned on the axis 41.

The pressure variations in the reservoir 12 (or in the ink of said reservoir or coming from said reservoir), may be produced by piezo-electric means 16, which may be controlled with the activation voltages and/or with the frequencies that have already been indicated above.

As illustrated in FIG. 14A, the piezo-electric means 16, 16' may be formed above the upper wall of the reservoir 12 and/or above any portion (for example channel 14) of a hydraulic circuit through which the ink from said reservoir 12 circulates and/or below the reservoir 12 and/or optionally the channel 14. The pressure variations may thus be applied to the ink contained in the reservoir 12 or to the ink that comes therefrom.

The pressure generated by the piezo-electric means follows the curve illustrated in FIG. 5 as a function of the amplitude of the oscillation applied to these means.

Consequently, by applying oscillations of variable amplitudes to the means 16 or 16', it is possible to generate pressure differences in the reservoir 12. For example, the piezo-electric means 16 or 16' are activated in such a way as to go beyond the threshold Ac of appearance of the non-linear regime, then to remain below this threshold.

It is thus possible, by this system, to produce a pressure variation in the reservoir 12 (or to a portion of the ink circulation circuit situated downstream of the reservoir 12 with respect to the direction of circulation of the ink from the reservoir to the outlet nozzle 30, but upstream of the outlet nozzle 30), which leads alternatively to a deviation of the jet formed at the outlet of the nozzle then to a jet aligned on the axis of the nozzle.

To reinforce the effect, the actuator, or each piezo-electric element, can work at its resonance frequency, which is preferable for favouring greater deformation amplitude.

Here again, the invention makes it possible to deviate a jet, with respect to the axis 41 of the nozzle, by an angle that may be of the order of several degrees, for example comprised between 3° and 10°. This is sufficient for application to a continuous ink jet printer.

An effect of deviation with a structure such as that of FIG. 14A is more sensitive if the radius of curvature $R_c$ of the part 31 is comprised between 0.5 $D_b$ and 1.5 $D_b$, where $D_b$ designates, as above, the diameter of the nozzle.

It is possible to produce structures such as those of each of FIGS. 3, 4, 6A-9 with the structure of FIG. 14A. Thus, in FIGS. 14B-14G are represented the structures, respectively FIGS. 3, 4, 6A-9, truncated on one side along a plane parallel to the plane OXZ, situated slightly beyond the nozzle 30. The numerical references of FIGS. 3, 4, 6A-9 designate in FIGS. 14B-14G the same elements as in FIGS. 3, 4, 6A-9 and the explanations given above in relation with these FIGS. 3, 4, 6A-9 also apply to these FIGS. 14B-14G. Similarly, the indications already given for each of FIGS. 3, 4, 6A-9 as regards the various parameters H, $H_c$, $D_b$, $H_c/D_b$, $h_b$ also apply here. In these figures, the junction 31 (visible in FIGS. 14B and 14E) between the nozzle 30 and the conduit 56 or the chamber 12 has a non-zero radius of curvature, the centre of curvature of which is situated on the external side of the device, and not on the side of the conduit 14. In particular:

$H_c/D_b$ is preferably comprised between 0.5 and 1.5, with the same technical reasons and advantages already mentioned above;

and/or, for the reasons already indicated above, the radius of curvature $R_c$ of the part 31 is preferably comprised between 0.5 $D_b$ and 1.5 $D_b$, where $D_b$ designates, as above, the diameter of the nozzle.

A device according to the invention is supplied with ink by a reservoir of ink not represented in the figures. Various fluidic connection means may be implemented to connect this reservoir to a print head according to the invention, and for recovering ink that comes from the recovery gutter. An example of complete circuit is described in U.S. Pat. No. 7,192,121 and may be used in combination with the present invention.

Whatever the envisaged embodiment, the instructions, to activate the means 16, 26, $\mathbf{16_1}$-$\mathbf{16_n}$, $\mathbf{26_1}$-$\mathbf{26_n}$ (or the other means such as thermal activation means or the mechanical activation means described above) to produce jets of ink and the means for pumping the gutter are sent by the control means (also called "controller"). It is also these instructions that are going to make it possible to make the pressurised ink flow in the direction of the print head, then to generate the jets as a function of the patterns to print on a support 8. These control means are for example realised in the form of an electric or electronic circuit or a processor or a microprocessor, programmed to implement a method according to the invention.

It is this controller which also controls the pumping means of the printer, and in particular the gutter, as well as the opening and the closing of valves on the path of the different fluids (ink, solvent, gas). The control means can also ensure the memorisation of data, for example measurement data of the levels of ink in one or more reservoirs, and the potential treatment.

Figure 1:
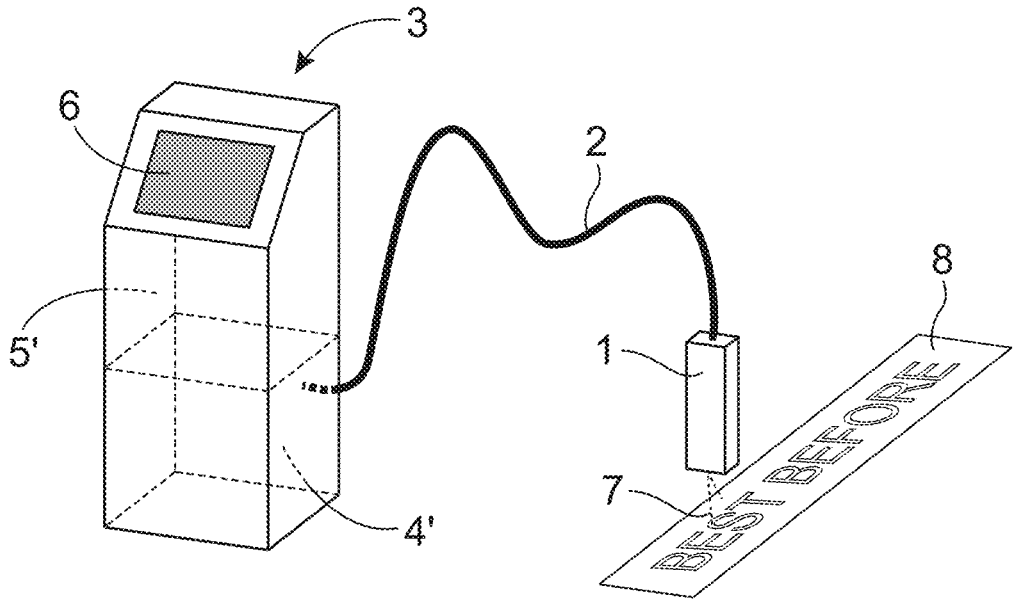
FIG. 1 represents a known printer structure.
Figure 2:
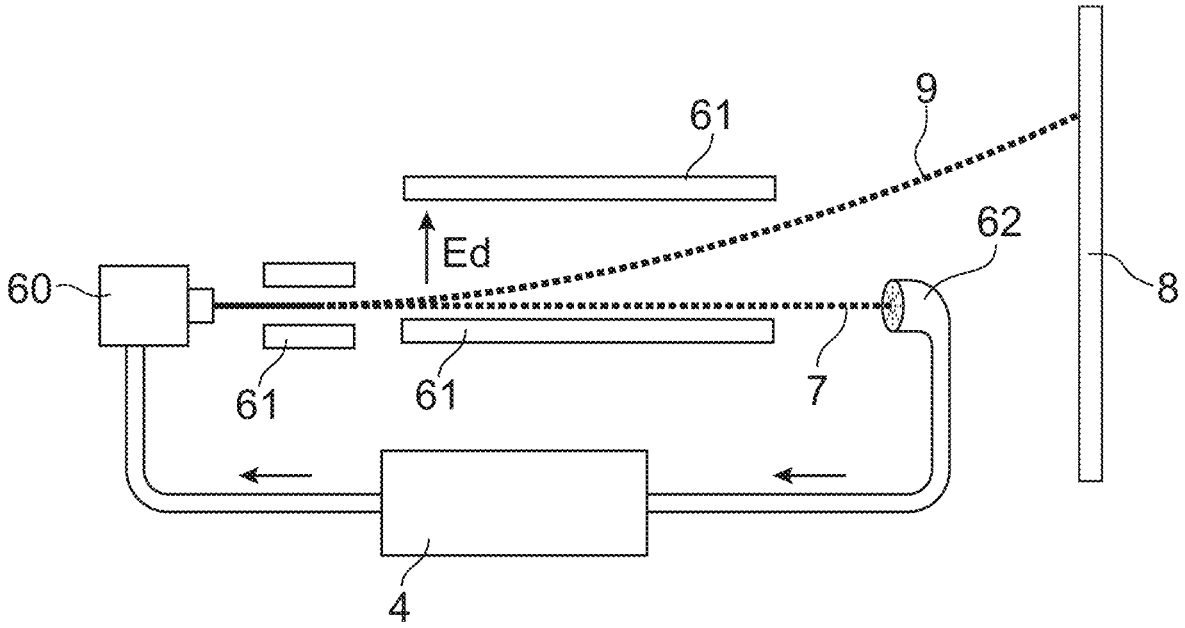
FIG. 2 represents a known structure of a print head of a CIJ type printer.

In FIG. 1 is represented the general structure of the main blocks of an ink jet printer that can implement one or more of the embodiments described above. The printer comprises a console 300, a compartment 400 notably containing circuits for conditioning ink and solvents, as well as reservoirs for ink and solvents (in particular, the reservoir to which the ink recovered by the gutter is brought). Generally the compartment 400 is in the lower part of the console. The upper part of the console comprises the command and control electronics as well as visualisation means. The console is hydraulically and electrically connected to a print head 100 via an umbilical 203.

A gantry, not represented, makes it possible to install the print head facing a printing support 8, which moves along a direction materialised by an arrow. This direction is perpendicular to an alignment axis of the nozzles.

Figure 16:
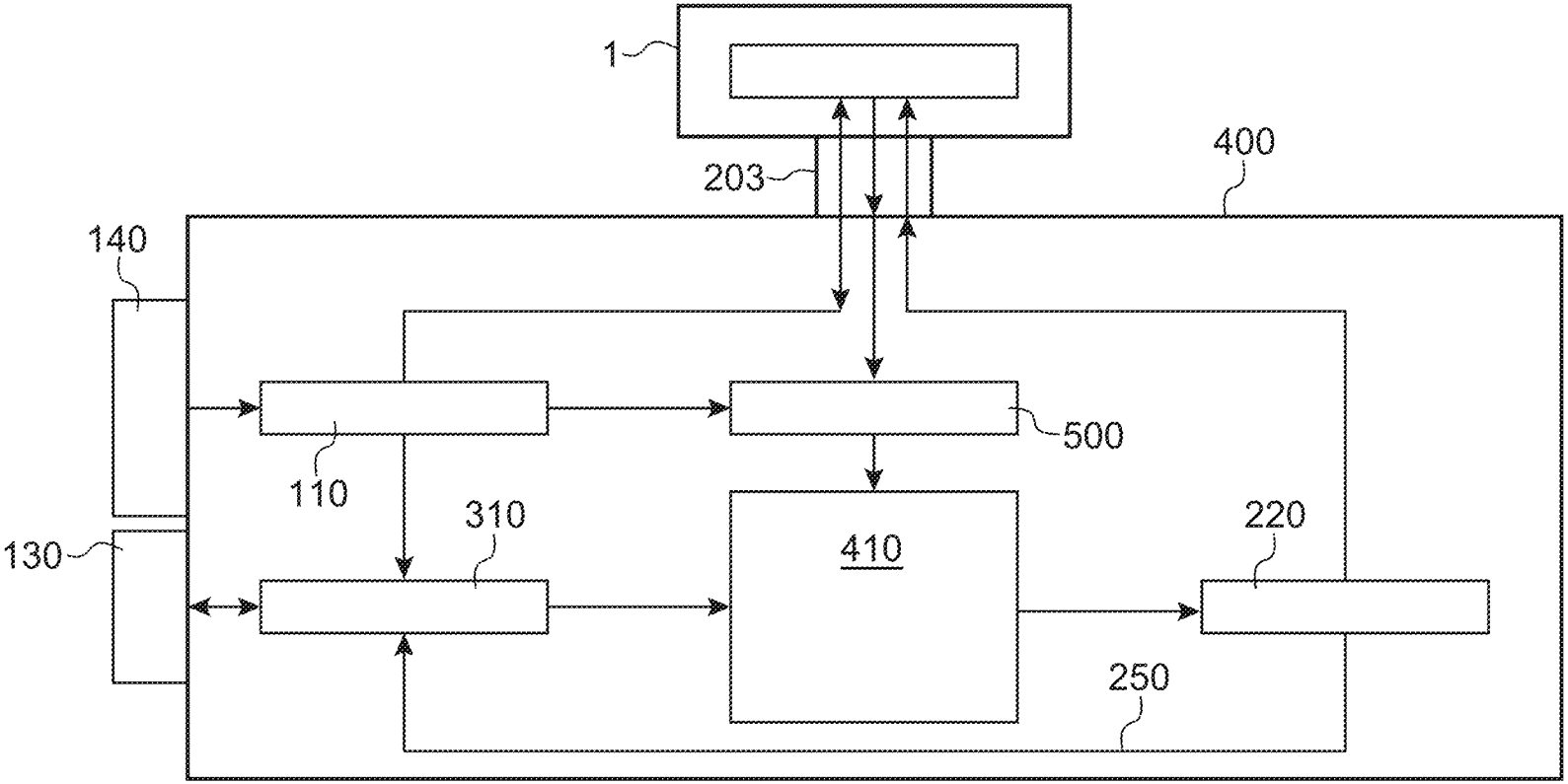
FIG. 16 represents a functional view of the printer.

An example of fluidic circuit 400 of a printer to which the invention may be applied is illustrated in FIG. 16. This fluidic circuit 400 comprises a plurality of means 410, 500, 110, 220, 310, each associated with a specific functionality. The head 1 and the umbilical 203 are also shown.

With this circuit 400 are associated a removable ink cartridge 130 and a solvent cartridge 140, also removable.

The reference 410 designates the main reservoir, which makes it possible to collect a mixture of solvent and ink.

The reference 110 designates the set of means that make it possible to withdraw, and potentially to store, solvent from a solvent cartridge 140 and to supply the solvent thus withdrawn to other parts of the printer, whether it involves supplying the main reservoir 410 with solvent, or cleaning or maintaining one or more of the other parts of the machine.

The reference 310 designates the set of means that make it possible to withdraw ink from an ink cartridge 130 and to provide the ink thus withdrawn to supply the main reservoir 410. As may be seen in this figure, according to the embodiment described here, the sending, to the main reservoir 410 and from the means 110, of solvent, goes through these same means 310.

At the outlet of the reservoir 410, a set of means, globally designated by the reference 220, makes it possible to pressurise the ink withdrawn from the main reservoir, and to send it to the print head 1. According to one embodiment, illustrated here by the arrow 250, it is also possible, by these means 220, to send ink to the means 310, then once again to the reservoir 410, which enables a recirculation of the ink inside the circuit. This circuit 220 also makes it possible to empty the reservoir in the cartridge 130 and to clean the connections of the cartridge 130.

The system represented in this figure also comprises means 500 for recovering fluids (ink and/or solvent) which return from the print head, more exactly the gutter 7 of the print head (FIG. 2) or the circuit for rinsing the head. These means 500 are thus arranged downstream of the umbilical 203 (with respect to the direction of circulation of the fluids that return from the print head).

As may be seen in FIG. 16, the means 110 may also make it possible to send solvent directly to these means 500, without going through either the umbilical 203 or through the print head 1 or through the recovery gutter.

The means 110 may comprise at least 3 parallel supplies of solvent, one to the head 1, the $2^{nd}$ to the means 500 and the $3^{rd}$ to the means 310.

Each of the means described above is provided with means, such as valves, preferably electromagnetic valves, which make it possible to orient the fluid concerned to the chosen destination. Thus, from the means 110, it is possible to send exclusively solvent to the head 1, or to the means 500 or to the means 310.

Each of the means 500, 110, 210, 310 described above may be provided with a pump that makes it possible to treat the fluid concerned (respectively: $1^{st}$ pump, $2^{nd}$ pump, $3^{rd}$ pump, $4^{th}$ pump). These different pumps ensure different functions (those of their respective means) and are thus different to each other, even if these different pumps may be of same or similar type: none of these pumps ensures 2 of these functions).

In particular, the means 500 comprise a pump ($1^{st}$ pump) which makes it possible to pump the fluid, recovered, as explained above, from the print head, and to send it to the main reservoir 410. This pump is dedicated to the recovery of this fluid coming from the print head and is physically different to the $4^{th}$ pump of the means 310 dedicated to the transfer of ink or the $3^{rd}$ pump of the means 210 dedicated to the pressurisation of ink at the outlet of the reservoir 410.

The means 110 comprise a pump (the $2^{nd}$ pump) which makes it possible to pump solvent and to send it to the means 500 and/or to the means 310 and/or to the print head 1.

Such a circuit 400 is controlled by the control means described above, these means are in general contained in the console 300 (FIG. 16).

The invention claimed is:

1. Print head of a continuous ink jet printer, comprising:

a first reservoir and a second reservoir, arranged on either side of at least one jet ejection nozzle to which they are connected;

a first actuator for applying pressure to the ink from the, or coming from the, 1st reservoir;

a second actuator for applying pressure to the ink of the, or coming from the, 2nd reservoir; and a controller for controlling the first actuator and the second actuator, wherein said controller is configured to control the first actuator and the second actuator to simultaneously and respectively apply first and second pressures to the ink of the, or coming from the, first and second reservoirs, such that a first jet of ink is ejected from the nozzle along a first trajectory, and wherein the first and second pressures have a non-zero pressure differential.

2. Print head according to claim 1, each of said first actuator and said second actuator comprising a piezo-electric or a thermal or a mechanical actuator.

3. Print head according to claim 2, each of said first actuator and said second actuator comprising a piezo-electric or thermal or mechanical actuator arranged on the side of the reservoirs in which the nozzle or nozzles emerge, or on the opposite side.

4. Print head according to claim 1, said controller configured to control the first actuator and the second actuator so as to:

simultaneously apply identical pressures to the ink of the, or coming from the, first and second reservoirs, and then simultaneously apply the first and second pressures to the ink of the, or coming from the, first and second reservoirs.

5. Print head according to claim 1, each reservoir being connected to the nozzle by at least one conduit and/or one chamber.

6. Print head according to claim 5:

said first actuator making it possible to apply pressure to the conduit or to the chamber which connects the first reservoir to the nozzle;

and said second actuator making it possible to apply pressure to the conduit or to the chamber which connects the second reservoir to the nozzle.

7. Print head according to claim 1, each reservoir being connected to the nozzle by a chamber, then a column, then a conduit.

8. Print head according to claim 1, comprising a plurality of jet ejection nozzles, and a plurality of first actuators and of second actuators, each associated with one of said ejection nozzles, for applying pressure to the ink of the, or coming from the, first reservoir, and pressure to the ink of the, or coming from the, second reservoir.

9. Print head according to claim 1, wherein:

an inlet of a nozzle has a diameter Db, each reservoir is connected to the nozzle by at least one conduit, the conduit having a width Hc, and Hc/Db is between 0.5 and 1.5.

10. Print head according to claim 1, a portion of a conduit that conveys the ink to an inlet of the nozzle having a curvature.

11. Ink jet printer comprising a print head according to claim 1, and a hydraulic circuit for supplying the print head with ink and/or with solvent, and for recovering ink not used for printing.

12. Print head according to claim 1, said controller configured to control the first actuator and the second actuator so as to:

simultaneously apply identical pressures to the ink of the, or coming from the, first and second reservoirs, such that a second jet of ink is ejected from the nozzle at a second trajectory, and then simultaneously apply the first and second pressures to the ink of the, or coming from the, first and second reservoirs, such that the first jet of ink is ejected from the nozzle at the first trajectory, the first trajectory being deviated from the second trajectory.

13. Print head according to claim 1, wherein the print head does not include heating means at an outlet of the nozzle.

14. Method for operating a print head of a continuous ink jet printer, comprising a first reservoir and a second reservoir, arranged on either side of a jet ejection nozzle, to which each of the reservoirs is connected, method in which:

first and second pressures are respectively and simultaneously applied to the ink of the, or coming from the, first and second reservoirs, such that a first jet of ink is ejected from the nozzle at a first trajectory, wherein the first and second pressures have a non-zero pressure differential.

15. Method according to claim 14, in which the first jet is deviated from an axis of the nozzle between 3° and 10°.

16. Method according to claim 14, in which the outlet speed of the first jet from the nozzle is comprised between 2 m/s and 15 m/s.

17. Method according to claim 14, in which:

identical pressures are simultaneously applied to the ink of the, or coming from the, first and second reservoirs, such that a second jet of ink is ejected from the nozzle at a second trajectory, and then the first and second pressures are simultaneously and respectively applied to the ink of the, or coming from the, first and second reservoirs, such that the first jet of ink is ejected from the nozzle at the first trajectory, the first trajectory being deviated from the second trajectory.

18. Method according to claim 17, wherein the second trajectory is aligned with an axis of the nozzle.

19. Method according to claim 14, wherein the print head does not include heating means at an outlet of the nozzle.

20. Print head according to claim 19, wherein the second trajectory is aligned with an axis of the nozzle.

* * * * *